US007882872B2

(12) United States Patent
Frierson

(10) Patent No.: US 7,882,872 B2
(45) Date of Patent: Feb. 8, 2011

(54) PROTECTIVE COVER FOR HAIR CLIPPERS SEATED IN A RACK

(76) Inventor: Harvey Levern Frierson, 3104 Olde Creek Trail, Matthews, NC (US) 28105

( * ) Notice: Subject to any disclaimer, the term of this patent is extended or adjusted under 35 U.S.C. 154(b) by 863 days.

(21) Appl. No.: 11/810,566

(22) Filed: Jun. 6, 2007

(65) Prior Publication Data

US 2008/0016697 A1 Jan. 24, 2008

(51) Int. Cl.
*B65D 51/02* (2006.01)
*B65D 65/02* (2006.01)

(52) U.S. Cl. ..... 150/161; 150/164; 150/165; 220/287; 220/210

(58) Field of Classification Search ..... 220/210, 220/287; 150/161, 164, 165
See application file for complete search history.

(56) References Cited

U.S. PATENT DOCUMENTS 4,254,888 A * 3/1981 Chandler ..... 220/694
5,890,244 A * 4/1999 Cartwright et al. ..... 5/663
6,520,201 B2 * 2/2003 Sweeney et al. ..... 137/377
2004/0099666 A1 * 5/2004 Ordiway ..... 220/287
2005/0115970 A1 * 6/2005 Watson ..... 220/287

* cited by examiner

*Primary Examiner*—Anthony Stashick
*Assistant Examiner*—James N Smalley
(74) *Attorney, Agent, or Firm*—F. Rhett Brockington

(57) ABSTRACT

The invention is a pre-conformed cover consisting of panels of a relatively strong flexible material assembled in a conformation that can protectively stretchedly cover and lockedly secure one or more hair clippers on a hair clipper rack. A locking means that has at least one first grommet positioned in an edge panel of the pre-conformed cover, and at least one strap terminated with a second grommet, where the at least one strap is attached to an opposing edge panel of the pre-conformed cover, such that by extending the strap, a lock can pass through the first and second grommet. Exemplary of a strong flexible material is rip-stop nylon, heavy-duty cloth, reinforced scrim plastic film, and ballistic cloth. The pre-conformed cover can be further comprised of pre-extended elastic strips or bands sewn in the edges panels.

3 Claims, 5 Drawing Sheets

PROTECTIVE COVER FOR HAIR CLIPPERS SEATED IN A RACK

FIELD OF THE INVENTION

The invention relates to coverings for handheld appliances, and more particularly to a protective cover for securing hair clippers when seated in a hair clipper rack.

BACKGROUND OF THE INVENTION

Barbers typically have several sizes of electric hair clippers, where each size is specialized for a type of cut, and where often each size has a backup hair clipper. When an electric hair clipper is not being used, the hair clipper is typically laid down, placed on a hook or in a rack mounted on a counter adjacent to the barber's chair. The hair clippers are often left out unprotected overnight, and in some cases for days and even weeks. Professional grade hair clippers are expensive, and in the wrong hands they can also present a safety hazard. Hair clipper racks are becoming increasingly popular as they provide a wire cradle that permits quick access to the various size hair clippers, and, unlike a counter or a drawer, a rack does not collect hair. Furthermore, in contrast to a drawer or a counter, a rack secures a hair clipper from being pulled down by its electrical cord from its storage position down to the floor, where impact damage to the clipper is likely.

While a rack provides improved access, organization, and restraint, it fails to provide any security from theft of the hair clipper, nor protect the hair clippers from exposure to microorganisms, ambient mists, (i.e. sprayed water), chemicals (i.e. hair dyes, bleaches), nor any protection from dust and oils. What is needed is a protective cover that can be quickly fastened over the hair clippers on the rack, where the protective cover can be lockedly secured, thereby deterring theft of the hair clippers, and provides a covering layer against ambient corrosive materials and microorganisms.

OBJECTS OF THE INVENTION

The principal object of the invention is to provide a protective cover for hair clippers seated in a rack, where the protective cover can be lockedly secured, and thereby deterring theft of the hair clippers.

Another object of the invention is to provide a barrier against ambient corrosive materials and microorganisms.

SUMMARY OF THE INVENTION

The invention is a pre-conformed cover comprised of panels of a relatively strong flexible material assembled to a conformation that is sized to protectively, stretchedly cover and lockedly secure one or more hair clippers on a hair clipper rack. The pre-conformed cover is further comprised of a locking means that has at least one first grommet positioned in an edge panel of the pre-conformed cover, and at least one strap terminated with a second grommet, where the at least one strap is attached to an opposing edge panel, such that by extending the strap, a lock can pass through the first and second grommet. Exemplary of a strong flexible material is rip-stop nylon, heavy-duty cloth, reinforced scrim plastic film, and ballistic cloth (i.e., HDPE, polyamid, aramid, fiberglass, and nylon fabric saturated with polyurethane). The pre-conformed cover can be further comprised of pre-extended elastic strips or bands sewn in the edge panels, which cause the edge panels to neck end. It is anticipated that the cover can also have an inside liner.

BRIEF DESCRIPTION OF THE DRAWINGS

The foregoing and other objects will become readily apparent by referring to the following detailed description and the appended drawings in which.

DESCRIPTION OF THE INVENTION

Figure 1:
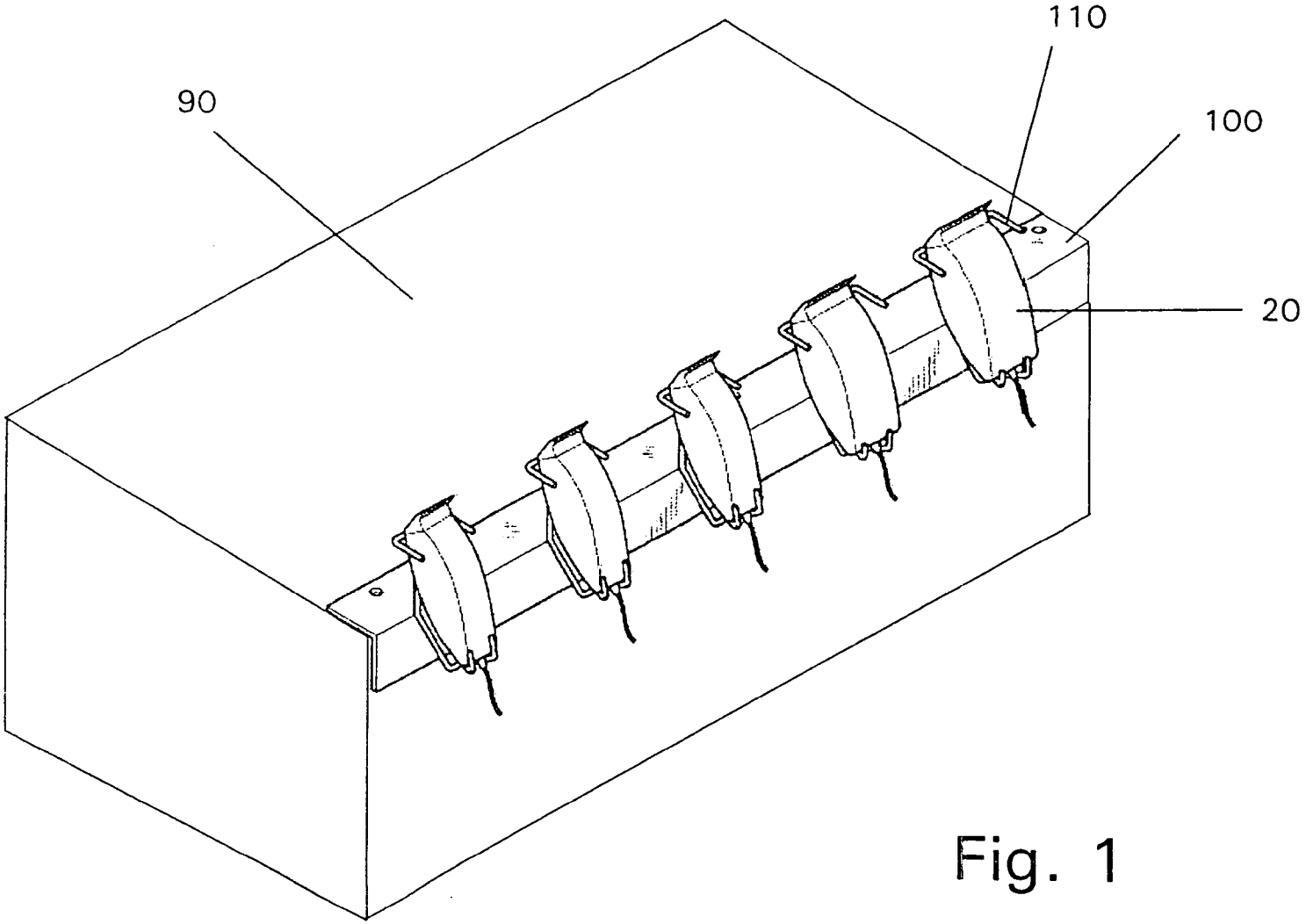
FIG. 1 is a perspective view of a five-station hair clipper rack having hair clippers, where the rack is mounted to the edge of a counter.
Figure 2:
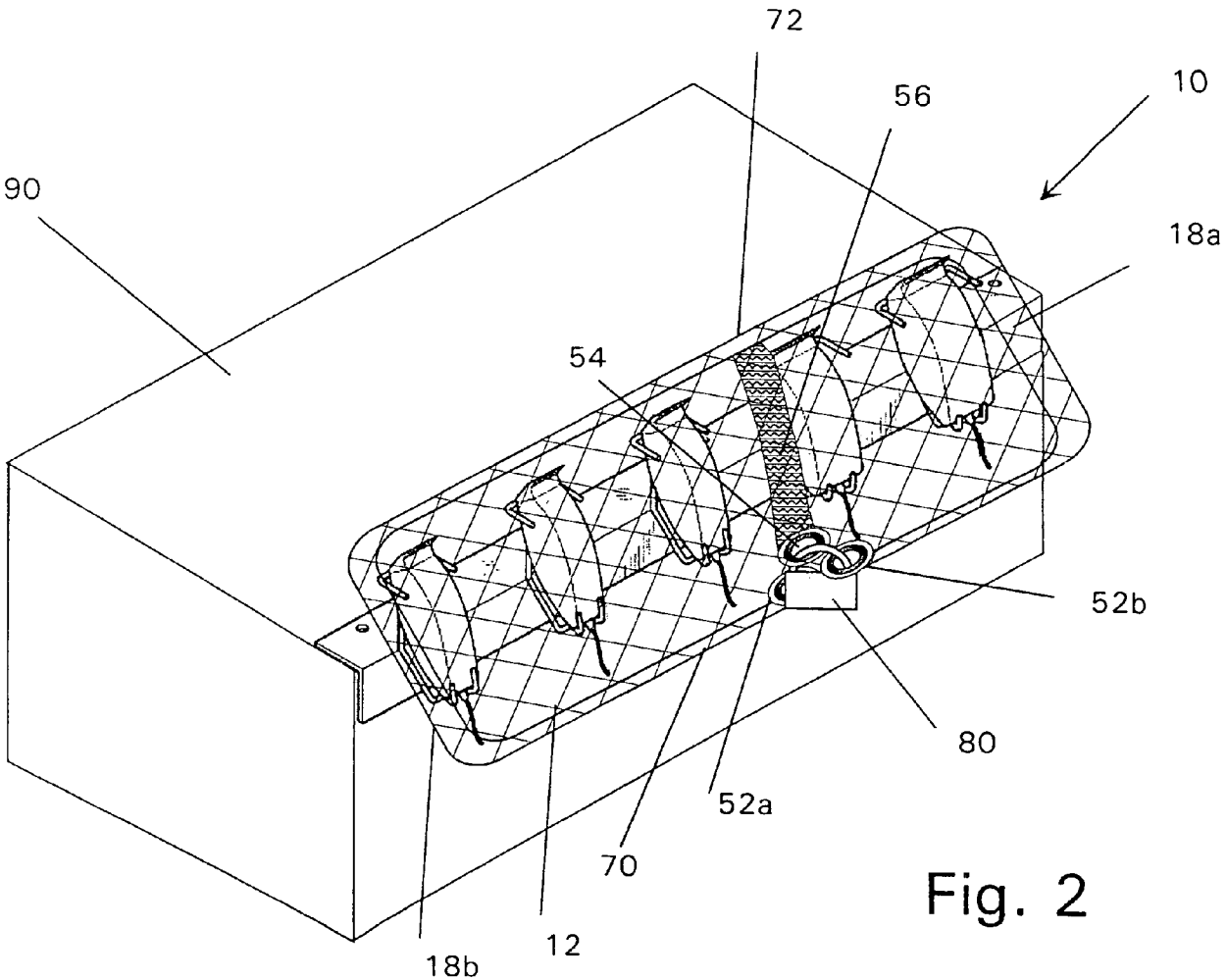
FIG. 2 is a perspective view of the invented protective cover, where the cover, which is locked, is comprised of a reinforced clear plastic flexible material, therein enabling one to quickly, visually determine that all hair clippers are present and are secured.

Referring to FIGS. 1 and 2, the invention is a pre-conformed cover 10 that is sized to stretchedly cover and lockedly secure one or more hair clippers on a hair clipper rack. FIG. 1 illustrates a five-station clipper rack 100 with individual wire stations 110, where the rack is mounted to a counter 90. Each station has a hair clipper 20. FIG. 2 is a perspective view of the invented cover 10, where the cover is fabricated using panels of a reinforced clear plastic flexible material, therein enabling one to quickly, visually determine that all hair clippers are present and are secured. Because the cover is clear, the viewer can see the strap, the rack, and the clippers, and the viewer should consider this when viewing FIG. 2. As is evident from the Figure, the cover has a locking means 50 which is comprised of a padlock 80, a strap with a second grommet 54, and two first grommets 52*a* and 52*b*, located in the edge panel 70. The strap 56 can be extended such that the lock 80 can secure all three grommets 52*a*, 52*b* and 54, as illustrated in FIG. 2. When the lock fastens the grommets, the two grommets in the edge panel 70 are pulled close together, in effect cinching the edge panels of the cover around the wire stations 110 of the rack 100. The cover also has a right side panel 18*a* and a left side panel 18*b*; and the edges of these panels would also be tightened when the grommets are pulled closer together.

Figure 3:
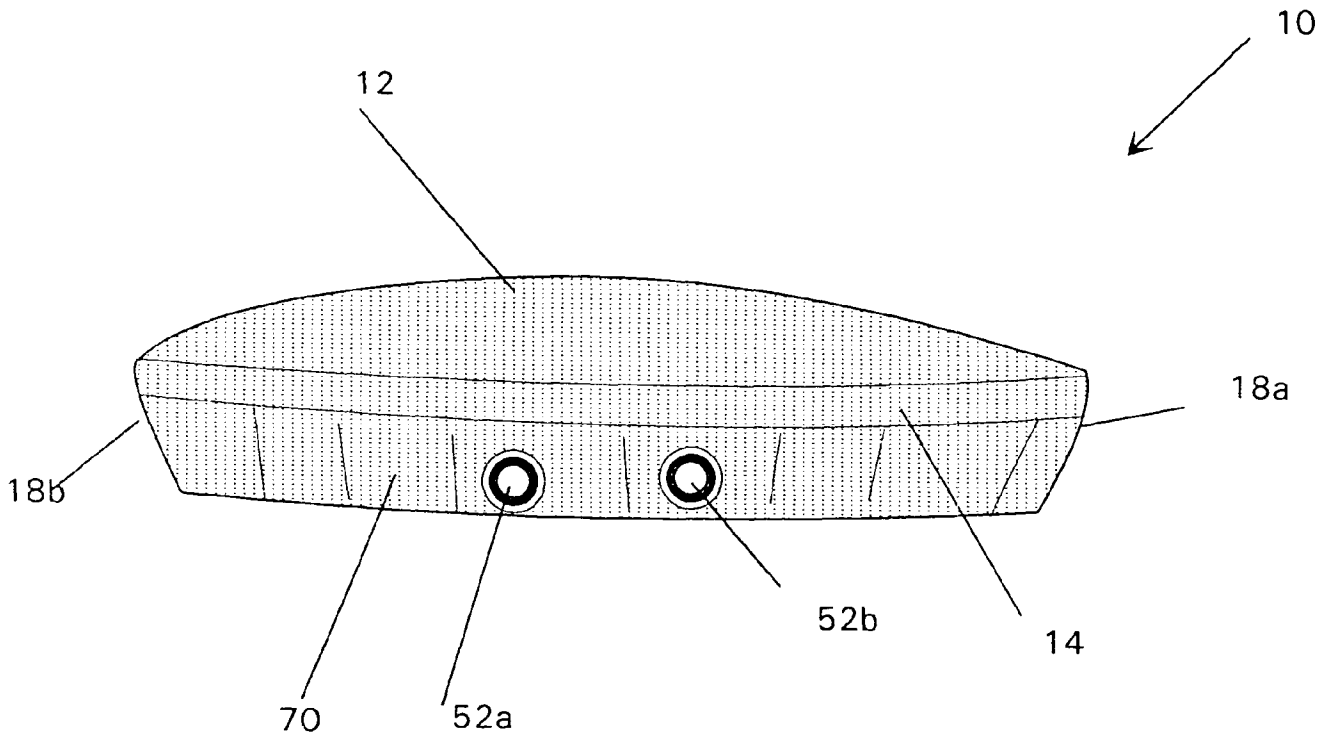
FIG. 3 is a side-view of the pre-conformed cover comprised of panels duty cloth, where the pre-conformed cover has substantially an open bottom rectangular conformation and is shown, as it exists when stretched around a rack of hair clippers.

In FIG. 3 the pre-conformed cover 10 is comprised of a heavy-duty cloth. The cover 10 substantially has a rectangular conformation with an elastic open bottom. The heavy-duty cloth cover 10 illustrated in FIG. 3 is shown from the bottom in FIG. 4.

Figure 4:
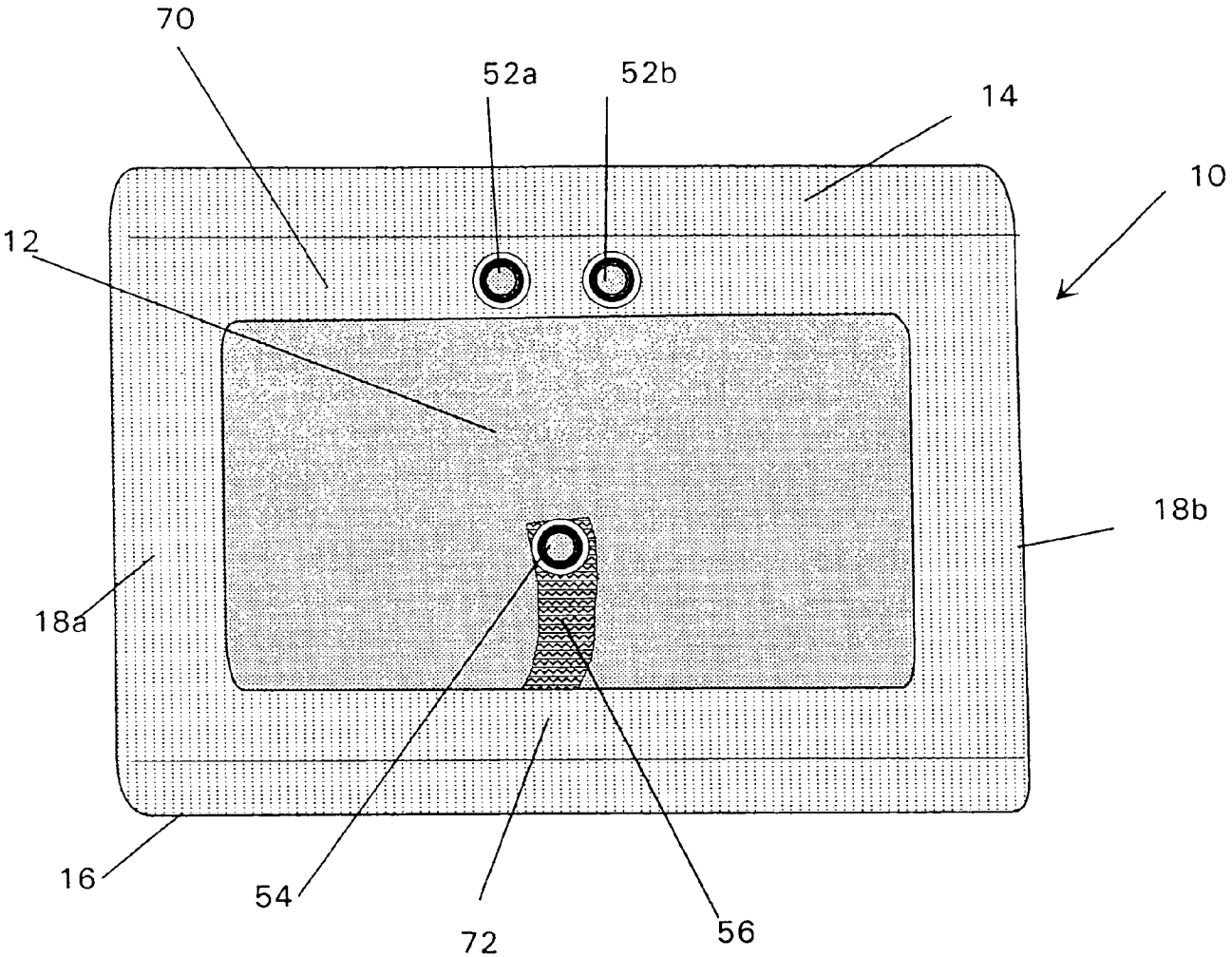
FIG. 4 is a planar bottom view of the pre-conformed cover illustrating the cover in a relaxed state.

FIG. 4 illustrates the cover 10 in a relaxed state. The two first grommets, 52*a* and 52*b* are located in the edge panel 70. The strap 56 is attached to an opposing edge panel 72. The inside of the top panel 12 comprises the center portion of the cover 10. The right and left side panels 18*a* and 18*b* have a hem 80*a* and 80*b* that is a continuing edge, with edge panels 70 and 72, and a common seam with side panels 14 and 16.

Figure 5:
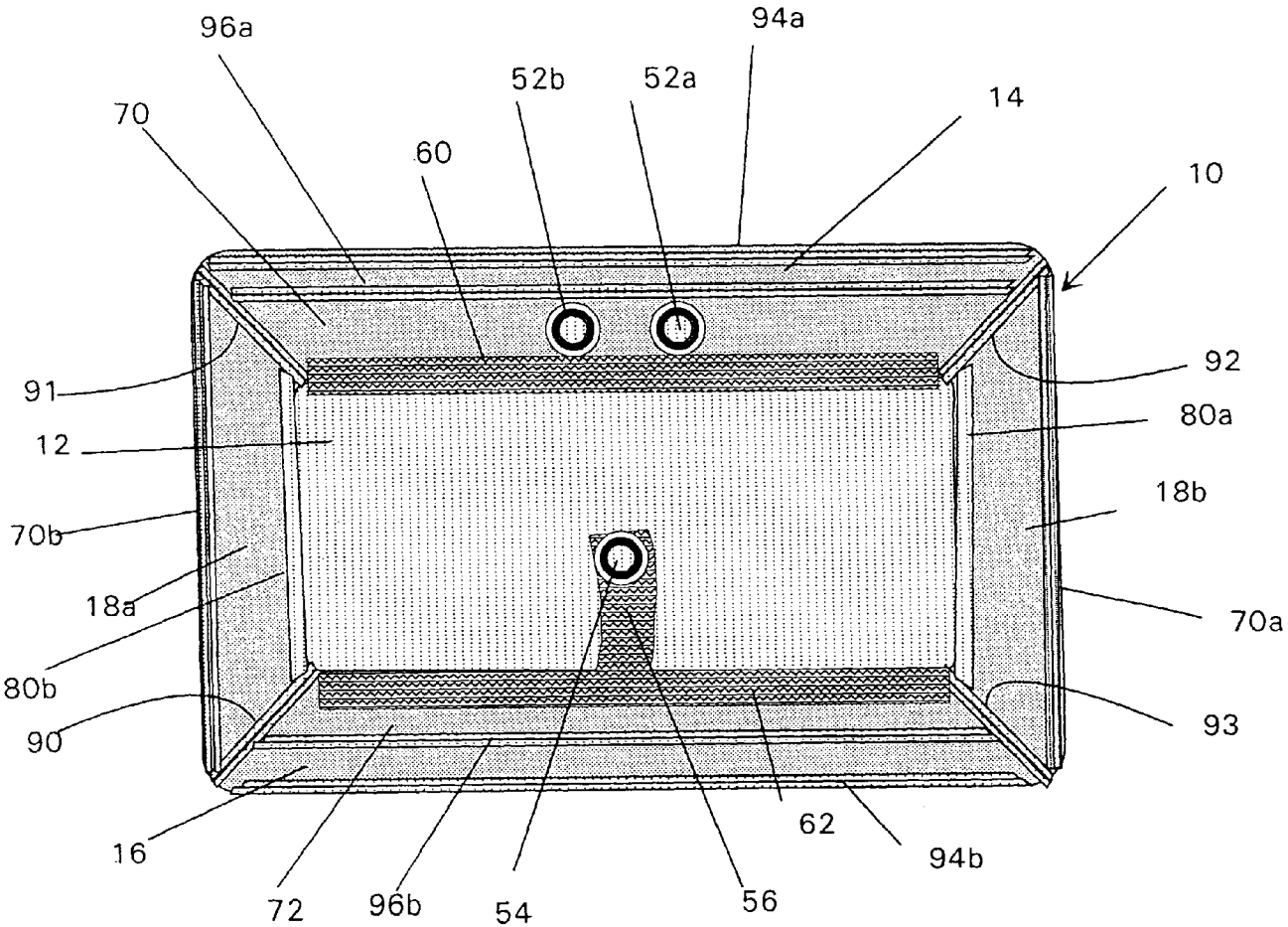
FIG. 5 is a planar view of an inverted pre-conformed cover illustrating the assemblage of panels of flexible material therein producing the pre-conformed cover with edge panel having pre-extended elastic bands.

FIG. 5 is a bottom view of the cover, where the cover is inverted therein enabling one to see a preferred assemblage of panels. The top panel 12 is attached to panels 16 and 14 by seam 94*a* and 96*a* respectively, and to panels 18*a* and 18*b* by seam 70*a* and 70*b* respectively. Panels 16 and 14 are attached to edge panels 72 and 70 by seams 96*a* and 96*b* respectively. The side panels 14 and 16, edge panels 70 and 72, and right and left panels 18*a* and 18*b* are attached with oblique seams 90-93. Pre-extended elastic bands 60 and 62 overlap the edge panel 70 and the opposing edge panel 72 which cause the edges to neck-in, except when held out by the wire stations 110 of the rack 100.

SUMMARY OF THE ACHIEVEMENTS OF THE OBJECTS OF INVENTION

The mechanical fastener, along with the features described herein, provides a protective cover for hair clipper seated in a rack, where the protective cover is pre-conformed to lockedly secure hair clippers seated on a rack. Furthermore, the flexible strong material used to fabricate the cover provides a barrier against ambient corrosive materials and microorganisms.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function, it is intended that such claim be construed to cover the corresponding structure, material, or acts described in the specification and equivalents thereof, including both structural equivalents and equivalent structures.

What is claimed is:

1. A pre-conformed cover, said pre-conformed cover comprising:

panels of a heavy-duty cloth assembled to a substantially rectangular conformation with an open bottom, said panels comprised of a top panel (12), an edge panel (70) with an elastic band (60), an opposing edge panel (72) with an opposing elastic band (62), a right side panel (18*a* ), and a left side panel (18*b*), where the elastic bands cause the edge panels to neck-in, and enable the cover to be stretched open and positioned over one or more hair clippers on a hair clipper rack having wire cradles, and a locking means comprised of a pair of grommets (52*a*, 52*b*) positioned in the edge panel (70) of the pre-conformed cover, and at least one strap (56) terminated with a grommet (54), where the at least one strap is attached to the opposing edge panel (72) of the pre-conformed cover, such that by extending the strap through the wire cradles, a single lock can pass through all the grommets, simultaneously pulling the opposing edge panel (72) toward the edge panel (70) with the strap, and shortening the edge panel (70), cinching the cover around the hair clippers and wire cradles on the hair clipper rack.

2. The pre-conformed cover, as claimed in claim 1, wherein said heavy-duty cloth is selected from the group consisting of rip-stop nylon, reinforced scrim plastic-film, and ballistic cloth.

3. The pre-conformed cover according to claim 1, wherein said bands (60,62) are sewn in the edge panel (70) and the opposing edge panel (72), and the bands extend to the right side panel (18*a*) and the left side panel (18*b*).

* * * * *